US006889914B2

(12) United States Patent
Herhold

(10) Patent No.: US 6,889,914 B2
(45) Date of Patent: May 10, 2005

(54) SHROUD ASSEMBLY FOR HIGH PRESSURE FLUID CLEANING LANCE

(75) Inventor: Matthew O. Herhold, Fenton, MI (US)

(73) Assignee: NLB Corp., Wixom, MI (US)

( * ) Notice: Subject to any disclaimer, the term of this patent is extended or adjusted under 35 U.S.C. 154(b) by 13 days.

(21) Appl. No.: 10/355,510

(22) Filed: Jan. 31, 2003

(65) Prior Publication Data

US 2004/0149836 A1 Aug. 5, 2004

(51) Int. Cl.[7] ..... B24C 5/04; B05C 5/00; B05B 7/02; B05B 9/00

(52) U.S. Cl. ..... 239/110; 239/124; 239/288.5; 239/587.3; 239/587.4

(58) Field of Search ..... 239/104, 110, 239/124, 288, 288.3, 288.5, 587.1, 587.2, 587.3, 587.4, 587.5, DIG. 8, DIG. 21

(56) References Cited

U.S. PATENT DOCUMENTS 1,087,006 A * 2/1914 Fitzsimons ..... 239/587.4
3,047,239 A * 7/1962 Canavan ..... 239/587.4
4,563,840 A * 1/1986 Urakami ..... 239/124
5,697,534 A * 12/1997 Huyghe ..... 239/587.4
5,904,297 A 5/1999 Kendrick, Jr.

* cited by examiner

*Primary Examiner*—Sheldon J Richter
(74) *Attorney, Agent, or Firm*—Carlson, Gaskey & Olds

(57) ABSTRACT

A unique shroud assembly covers the outlet nozzle of a high pressure hand held discharge device. The shroud assembly has a stationary tubular sleeve spaced generally circumferentially about the outlet nozzle and a pivotable tubular end cuff that is spaced from and encircles the outlet end of the stationary tubular sleeve. The pivotable tubular end cuff is capable of pivoting along the longitudinal axis of the outlet nozzle of the spray device. This enables the operator to hold the outlet nozzle at a plurality of angles with respect to the surface being treated while maintaining the necessary flush contact of the outlet opening of the discharge device with the treated surface. Additionally, the stationary tubular sleeve is provided with a laterally positioned outlet for attachment to a vacuum source to suction expelled fluid carrying loosened debris from the treated surface. The pivotable tubular end cuff may have ball bearings provided on an end surface that is in sliding contact with the treated surface in order to reduce surface friction.

11 Claims, 2 Drawing Sheets

SHROUD ASSEMBLY FOR HIGH PRESSURE FLUID CLEANING LANCE

BACKGROUND OF THE INVENTION

The present invention relates to a unique shroud assembly for the outlet nozzle of a high pressure cleaning lance.

Pressurized fluid spray devices are used to spray high pressure fluids against various types of surfaces which require cleaning. One type of cleaning device is hand held and known as a lance. When spraying highly pressurized fluids from a spray device, the outlet nozzle is moved along the surface to be treated by the spray device operator. Pressurized water exits the device at pressures up to 40,000 psi.

High pressure water is ejected from the outlet nozzle of the spray device strikes the surface undergoing the cleaning treatment. The highly pressurized water loosens and removes matter and debris from the surface being treated. The devices can be used for cleaning dirt, etc. or removing paint or other coatings. The fluid, along with loosened matter and debris, flow around the nozzle. This chaotic discharge of elements inhibits the vision of the operator, may impact the operator or others, and may be desirable to contain for safety or environmental reasons. Further, the flying debris is undesirable.

It would be desirable to provide a pressurized water spray device which may afford the operator greater control of water and debris as it is worked along a surface undergoing cleaning treatment.

It would further be desirable to eliminate or significantly reduce the chaotic discharge of elements from the outlet nozzle of the pressurized spray device such that an optimum safety level may be achieved by reducing mist, debris and water so that the visibility of the operator is not impeded and not exposed to harmful material.

The unique shroud assembly of the present invention is effective in eliminating the chaotic discharge of elements from the outlet nozzle of the pressurized fluid spray device while optimizing control of the device by the operator.

SUMMARY OF THE INVENTION

In the disclosed embodiment of this invention the outlet nozzle of a hand-held pressurized water spray device is provided with a unique shroud assembly. The unique shroud assembly includes a stationary tubular sleeve that is generally spaced circumferentially about the outlet nozzle and also has an outlet opening end that extends beyond the opening of the outlet nozzle. The extended outlet end of the stationary tubular sleeve is encircled by a pivotable tubular end cuff that is spaced from and extends beyond the outlet end of the shroud assembly. This pivotable tubular end cuff is capable of pivoting along any axis that is perpendicular to the longitudinal axis of the outlet nozzle of the spray device. In addition, the stationary tubular sleeve is provided with a laterally positioned outlet which is attached to a vacuum source.

During use, the operator maintains the outlet assembly of the pressurized fluid spray device in sliding contact with the surface undergoing treatment. The hand held spray device can be idealized as held directly perpendicular to the treatable surface. However this ideal position is difficult and sometimes unrealistic to maintain. The pivotable tubular end cuff enables the outlet assembly to remain flush with the treatable surface in the event that the spray device is directed away from the perpendicular position.

In addition, the pivotable tubular end cuff is spaced apart from the stationary tubular sleeve such that an air inlet is formed. This air inlet allows the inflow of air. During use a vacuum source is attached to the laterally positioned outlet in the stationary tubular sleeve. Air and expelled fluid carrying matter and debris from the surface being treated are suctioned out by way of the vacuum through the lateral outlet to subsequent suitable waste treatment.

These and other features of the present invention can be best understood from the following specification and drawings, the following of which is a brief description.

DETAILED DESCRIPTION OF THE DRAWINGS

Figure 1:
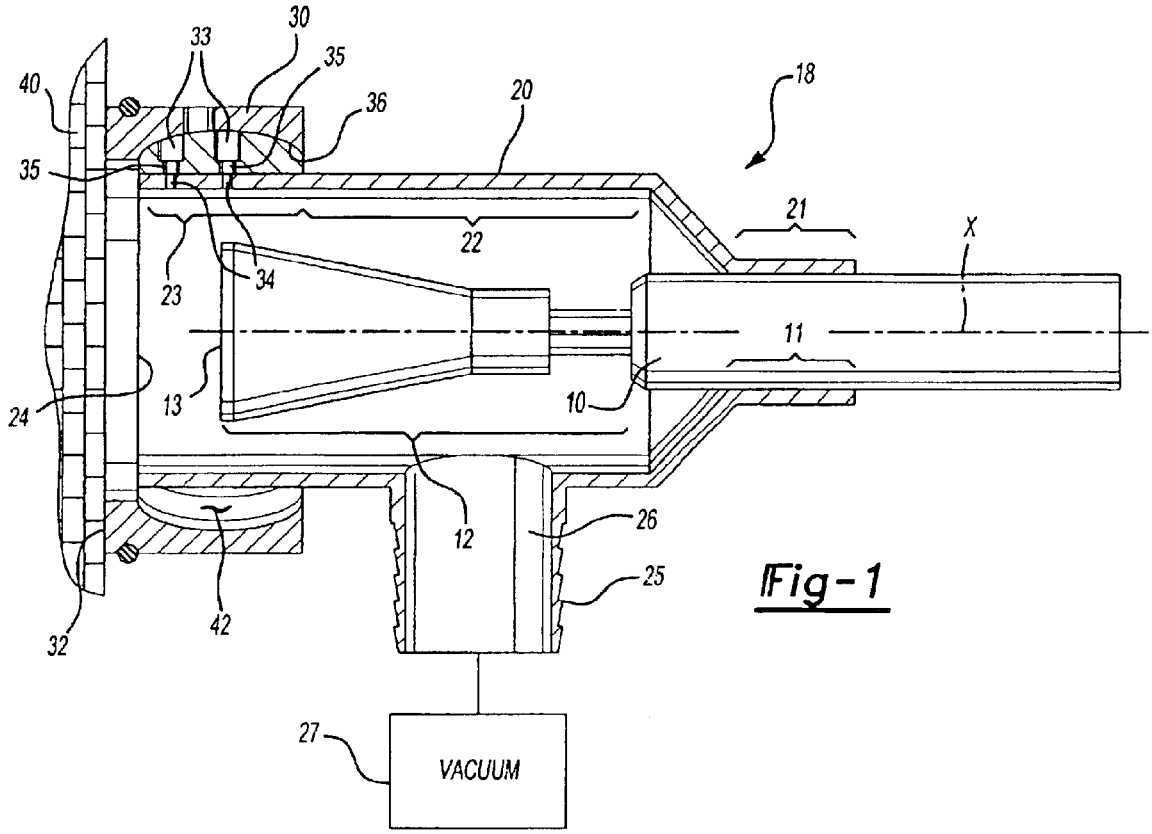
FIG. 1 is a schematic cross sectional view of the shroud assembly of the present invention.

With reference to FIG. 1, the outlet nozzle of a pressurized fluid spray device is shown at 10. The fluid spray device is shown schematically throughout the drawings in this application. However, as is understood in the art, it would generally function to receive and discharge a very high pressure water jet against the surface to be cleaned. As an example, one such device is described in U.S. Pat. No. 5,904,297. The inventive shroud assembly is indicated generally at 18 and includes tubular sleeve 20 and pivotable end cuff 30. Tubular sleeve 20 is formed from a suitable material such as aluminum or magnesium, and has a first inlet end 21 that is sealingly maintained about a portion 11 of outlet nozzle 10. Tubular sleeve 20 has a mid section 22 which encircles and is spaced from the outlet opening assembly 12 of outlet nozzle 10 and a distal end portion 23 having a distal end outlet opening 24 which extends beyond the outlet nozzle opening 13 of outlet nozzle 10 with respect to the direction of travel of pressurized fluid. Mid segment 22 of tubular sleeve 20 is provided with a tubular vacuum attachment element 25 positioned generally perpendicular to the longitudinal axis of the outlet nozzle 10 indicated at X. Tubular vacuum attachment element 25 attaches to tubular sleeve 20 at vacuum outlet opening 26 and connects to a vacuum source indicated schematically at 27. Pivotable end cuff 30 encircles and is spaced from tubular sleeve 20 at distal end portion 23. Pivotable end cuff 30 includes surface contact outlet 32 which, during use, will be in flush sliding contact with a surface to be treated indicated at 40. Surface contact outlet 32 of pivotable end cuff 30 extends beyond the distal end outlet opening 24 of tubular sleeve 20 with respect to the direction of travel of pressurized fluid. The spaced position of pivotable end cuff 30 with respect to tubular sleeve 20 allows for an air inlet 42 there between. Air inlet 42 enables the inflow of air when vacuum source 27 is energized.

Pivotable end cuff 30 is capable of pivoting about any axis that is perpendicular to the longitudinal axis X of the outlet nozzle 10. Pivotable end cuff 30 is maintained in a pivotable spaced relation to tubular sleeve 20 by way of a series of spacer elements 33 which will be further apparent from the description of the end view in FIG. 2.

Still referring to the cross sectional schematic view in FIG. 1, spacer elements 33 are fixedly attached to end portion 23 of tubular sleeve 20 at attachment points 34. Spacer elements 33 each have an exterior convex contact surface 35 which is in sliding contact with a concave interior contact surface 36 of pivotable end cuff 30.

Figure 2:
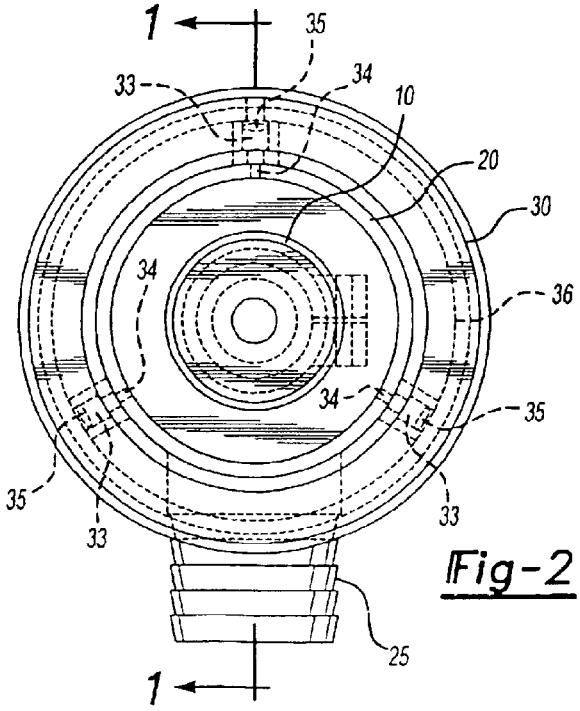
FIG. 2 is a schematic end view of a simplified cross section of the shroud assembly of the present invention.

Referring now to FIG. 2, the schematic end view of the outlet of the inventive shroud assembly, the outlet nozzle is indicated at 10, the tubular sleeve at 20 and the pivotable end cuff at 30. The tubular vacuum attachment element is indicated at 25. A series of spacer elements 33 are fixedly positioned equidistantly about tubular sleeve 20 at attachment points 34. Exterior convex contact surfaces 35 of spacer elements 33 are in sliding contact with the concave interior contact surface 36 of pivotable end cuff 30. Hence, the pivotable end cuff 30 is not attached to, but rather, it is suspended from the tubular sleeve 20 by way of spacer elements 33. The sliding relation of exterior convex contact surfaces 35 of spacer elements 33 and the concave interior surface 36 of pivotable end cuff 30 enables the partial pivoting of pivotable end cuff 30 about any axis perpendicular to the longitudinal axis of the outlet nozzle 10 which in this view is indicated at point X.

Figure 3:
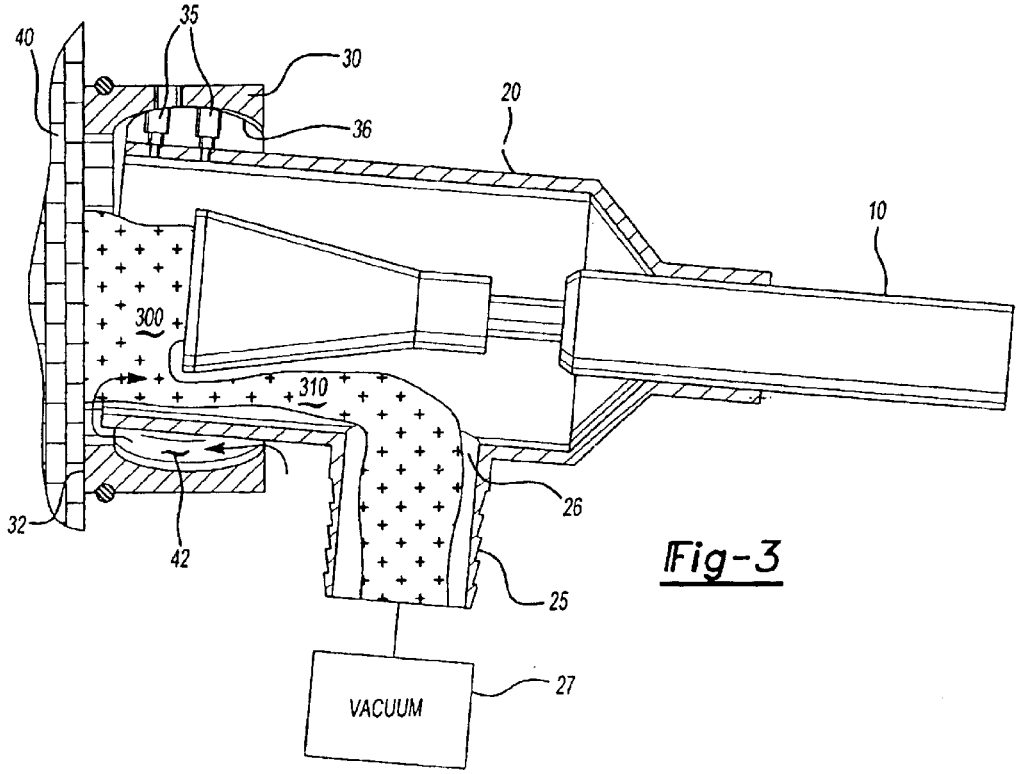
FIG. 3 is a schematic view of the pivoting motion of the shroud assembly of the present invention.

FIG. 3 demonstrates the pivoting action of the pivotable end cuff of the inventive shroud assembly. Ideally, during use the outlet of the fluid spray device is maintained in direct flush contact with the surface being treated. The pivoting ability of the pivotable end cuff of the inventive shroud assembly enables the operator to maintain flush direct contact of the fluid spray device outlet with the surface being treated without needing to maintain the spray device outlet nozzle at a constant 90 degree angle with respect to the surface undergoing treatment which may be difficult or uncomfortable to do. Thus the operator may vary the angle of the spray device with respect to the surface undergoing treatment while still maintaining direct flush contact with the treated surface.

Referring now to FIG. 3, the outlet nozzle is indicated at 10, the tubular sleeve at 20 and the pivotable end cuff at 30. During use, surface contact outlet 32 of pivotable end cuff 30 is in flush sliding contact with surface 40. As the outlet nozzle 10 is held in a position that is not perpendicular to surface 40, the sliding ability of the exterior convex contact surfaces 35 of spacer elements 33 with respect to the concave interior surface 36 of pivotable end cuff 30 allows the flush sliding contact of surface contact outlet 32 and surface 40 to be maintained. While the motion of the outlet nozzle 10 with respect to the surface undergoing treatment 40 is indicated as a downward motion in FIG. 3, it is to be understood that the outlet nozzle 10 may be positioned in any direction with respect to the surface undergoing treatment 40.

Referring still to FIG. 3, the inventive shroud assembly operates as follows. Highly pressurized fluid 300 is discharged through outlet nozzle opening 13 of outlet nozzle 10 toward surface 40 and vacuum source 27 is energized. The surface contact outlet 32 is in flush sliding contact with surface 40. The highly pressurized fluid 300 serves to dislodge debris 310 from surface 40. Air flows into the shroud assembly through air inlet 42. Vacuum source 27 attached to tubular vacuum attachment element 25 applies suction so that air and discharged fluid combined with loosened debris are expelled through outlet opening 26 so that they may be further routed for subsequent waste treatment.

Figure 4:
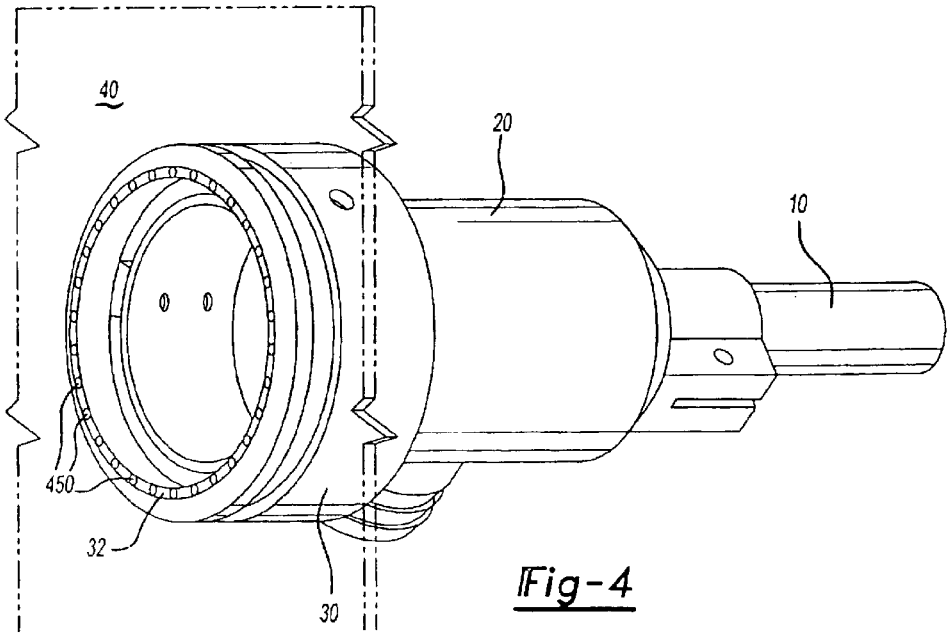
FIG. 4 is a schematic view of an alternative embodiment of the shroud assembly of the present invention.

FIG. 4 is a view of an alternative embodiment of the shroud assembly of the present invention. The outlet nozzle is indicated at 10, the tubular sleeve at 20 and the pivotable end cuff at 30. In this embodiment the surface contact outlet 32 of pivotable end cuff 30 is provided with a plurality of ball bearings 450. The provision of ball bearings 450 reduces friction to enable a smooth transition as the surface contact outlet 32 slides in flush contact along the surface undergoing treatment.

A preferred embodiment of this invention has been disclosed, however, a worker in this art would recognize that certain modifications would come within the scope of this invention. For that reason, the following claims should be studied to determine the true scope and content of this invention.

What is claimed is:

1. A hand-held pressurized fluid spray device comprising:

an outlet nozzle extending along an axis and having an outlet nozzle opening;

a shroud assembly having a tubular sleeve encircling said outlet nozzle, said tubular sleeve having a first inlet end that is sealingly maintained about a portion of said outlet nozzle, a mid section and a distal outlet opening that encircles and is spaced from said outlet nozzle opening;

a pivotable end cuff encircling said distal outlet opening, said pivotable end cuff being able to pivot about said axis of said outlet nozzle;

said pivotable end cuff being slidingly maintained on said distal outlet opening by way of a series of spacer elements fixedly attached to one of said distal outlet opening and said pivotable end cuff; and said spacer elements each have an exterior convex contact surface which is in sliding contact with a concave interior surface of the other of said pivotable end cuff and said distal outlet opening.

2. A device as recited in claim 1, wherein said spacer elements are fixed to said distal outlet opening.

3. A hand-held presurized fluid device comprising:

an outlet nozzle extending along an axis and having an oulet nozzle opening;

a shroud assenbly having a tubular sleeve encircling said outlet nozzle, said tubular sleeve having a first inlet end that is sealingly maintained about a portion of said outlet nozzle, a mid section and a distal outlet opening that encircles and is spaced from said outlet nozzle opening, said distal outlet opening being beyond said outlet nozzle, such that fluid leaving said outlet nozzle enters a space defined by said shroud assembly, and the fluid then being directed against a surface to be cleaned through said distal outlet opening;

an end of said fluid spray device being able to pivot about said axis of said outlet nozzle;

said end being a pivotable end cuff encircling said distal outlet opening, said pivotable end cuff being able to pivot about said axis of said outlet nozzle; and said pivotable end cuff having a contact surface outlet that is able to maintain flush sliding contact with a surface, whereby said contact surface outlet is provided with a plurality of ball bearings to reduce friction an said contact surface outlet is in flush sliding contact with the surface.

4. A hand-held pressurized fluid spray device comprising:

an outlet nozzle extending along an axis and having an outlet nozzle opening;

a shroud assembly having a tubular sleeve encircling said outlet nozzle, said tubular sleeve having a first inict end that is sealingly maintained about a portion of said outlet nozzle, a mid section and a distal outlet opening that encircles and is spaced from said outlet nozzle opening;

a pivotable end cuff encircling said distal outlet opening, said pivotable end cuff being able to pivot about said axis of said outlet nozzle; and said mid section is provided with an opening that opens to a tubular vacuum attachment element, said tubular vacuum attachment element being positioned perpendicular to said axis of said outlet nozzle.

5. A hand-held pressurized fluid spray device comprising:

an outlet nozzle extending along an axis and having an outlet nozzle opening; and a shroud assembly having a tubular sleeve encircling said outlet nozzle, said tubular sleeve having a first inlet end that is sealingly maintained about a portion of said outlet nozzle, a mid section and a distal outlet opening that encircles and is spaced from said outlet nozzle opening, said distal outlet opening being beyond said outlet nozzle, such that fluid leaving said outlet nozzle enters a space defined by said shroud assembly, and the fluid then being directed against a surface to be cleaned through said distal outlet opening; and an end of said fluid spray device being able to pivot about said axis of said outlet nozzle; and said mid section being provided with an opening that opens to a tubular vacuum attachment element, said tubular vacuum attachment element being positioned perpendicular to said axis of said outlet nozzle.

6. A device as recited in claim 5, wherein said end is a pivotable end cuff encircling said distal outlet opening, said pivotable end cuff being able to pivot about said axis of said outlet nozzle.

7. A device as recited in claim 6, wherein said pivotable end cuff is slidingly maintained on said distal outlet opening by way of a series of spacer elements fixedly attached to one of said distal outlet opening and said pivotable end cuff.

8. A shroud assembly for an outlet nozzle of a pressurized fluid spray device wherein said outlet nozzle lies along an axis and has an outlet nozzle opening, said shroud assembly comprising:

a tubular sleeve for encircling the outlet nozzle, said tubular sleeve having a first inlet end to be sealingly maintained about a portion of the outlet nozzle, a mid section and a distal outlet opening that is to encircle and be spaced from the outlet nozzle and the outlet nozzle opening; and a pivotable end cuff encircling said distal outlet opening, whereby said pivotable end cuff is able to pivot about any axis perpendicular to the axis of the nozzle outlet; and said mid section is provided with an opening that opens to a tubular vacuum attachment element.

9. A shroud assembly as recited in claim 8, wherein said pivotable end cuff is slidingly maintained on said distal outlet opening by way of a series of spacer elements fixedly attached to said distal outlet opening.

10. A shroud assembly as recited in claim 9, wherein said spacer elements each have an exterior convex contact surface which is in sliding contact with a concave interior surface of said pivotable end cuff.

11. A shroud assembly as recited in claim 10, wherein said pivotable end cuff has a contact surface outlet that is able to maintain flush sliding contact with a surface, whereby said contact surface outlet is provided with a plurality of ball bearings to reduce friction as said contact surface outlet is in flush sliding contact with said surface.

* * * * *

UNITED STATES PATENT AND TRADEMARK OFFICE

CERTIFICATE OF CORRECTION

PATENT NO. : 6,889,914 B2
DATED : May 10, 2005
INVENTOR(S) : Herhold

It is certified that error appears in the above-identified patent and that said Letters Patent is hereby corrected as shown below:

Column 4,
Line 37, insert -- spray -- after “fluid” and before “device”.
Line 59, “an” should be -- as --.
Line 66, “inict” should be -- inlet --.

Signed and Sealed this

Sixteenth Day of August, 2005

JON W. DUDAS
*Director of the United States Patent and Trademark Office*